US005866753A

United States Patent [19]

Deam et al.

[11] Patent Number: 5,866,753

[45] Date of Patent: Feb. 2, 1999

[54] MATERIAL PROCESSING

[75] Inventors: Rowan Thomas Deam, Briar Hill; Trevor Neil Kearney, Greensborough; Ian Michael Ogilvy, North Balwyn; Alan Edward Mundy, Sunbury; Paul Adrian Zemancheff, Essendon; Athos Ivan Vit, Elwood, all of Australia

[73] Assignees: Commonwealth Scientific; Industrial Research Organisation, both of Campbell, Australia

[21] Appl. No.: 633,556

[22] Filed: Apr. 17, 1996

Related U.S. Application Data

[63] Continuation of Ser. No. 295,832, filed as PCT/AU93/00089, Mar. 4, 1993, abandoned.

[30] Foreign Application Priority Data

Mar. 4, 1992 [AU] Australia ..... PL1188
Mar. 4, 1993 [AU] Australia ..... PCT/AU93/00089

[51] Int. Cl.[6] ..... A62D 3/00

[52] U.S. Cl. ..... 588/227; 588/205; 588/900; 204/157.15; 204/157.3; 204/158.2; 110/346; 422/186.21; 422/186.23

[58] Field of Search ..... 588/205, 227, 588/900; 204/157.15, 157.3, 158.2; 110/346; 422/186.21, 186.23

[56] References Cited

U.S. PATENT DOCUMENTS

| | | | |
|---|---|---|---|
| 3,676,519 | 7/1972 | Dorn et al. | 260/683 |
| 4,479,443 | 10/1984 | Faldt et al. | 110/346 |
| 4,508,040 | 4/1985 | Santén et al. | 110/347 |
| 4,644,877 | 2/1987 | Barton et al. | 110/250 |
| 4,898,748 | 2/1990 | Kruger, Jr. | 427/38 |
| 4,950,309 | 8/1990 | Schulz | 48/197 R |
| 4,980,092 | 12/1990 | Pineau et al. | 252/632 |
| 4,989,522 | 2/1991 | Cline et al. | 110/250 |
| 5,010,829 | 4/1991 | Kulkarni | 110/346 |
| 5,095,828 | 3/1992 | Holden et al. | 110/250 |
| 5,108,716 | 4/1992 | Dummersdorf et al. | 422/186.23 |
| 5,108,718 | 4/1992 | Dummersdorf | 422/186.23 |
| 5,138,959 | 8/1992 | Kulkarni | 110/346 |
| 5,206,879 | 4/1993 | Moody et al. | 373/22 |
| 5,280,757 | 1/1994 | Carter et al. | 110/346 |
| 5,534,659 | 7/1996 | Springer et al. | 588/227 |

FOREIGN PATENT DOCUMENTS

| | | |
|---|---|---|
| 1040148 | 3/1990 | China . |
| A2635371 | 2/1990 | France . |
| 1035191 | of 1966 | United Kingdom . |

OTHER PUBLICATIONS

Hawley's Condensed Chemical Dictionary, 11th Ed. (1987), p. 985.

Hutchinson Dictionary of Science (1993), p. 482.

McGraw–Hill Encyclopedia of Science and Technology (1994).

*Primary Examiner*—Cecilia J. Tsang
*Assistant Examiner*—C. Delacroix-Muirheid
*Attorney, Agent, or Firm*—Edward S. Irons

[57] ABSTRACT

A material treatment process and apparatus are described, wherein the formation within a pyrolyser of a plasma having a temperature of at least 10,000° C. into which material to be treated is injected as a fine spray or gas and wherein said material is moved as a stream through the pyrolyser toward the exit while maintained at a high temperature.

29 Claims, 4 Drawing Sheets

MATERIAL PROCESSING

This application is a continuation of Ser. No. 08/295,832, which is (PCT) 371 of PCT/AU93/00089, filed Mar. 4, 1993 abandoned.

This invention relates to material processing such as the destruction of toxic waste matter, and is concerned with both a process and apparatus. It will be convenient to hereinafter particularly describe the invention with reference to the example application to destruction of waste matter.

This invention relates particularly but not exclusively to treatment of waste products resulting from chemical treatment, chemical conversion and the like. These products often contain highly toxic directly physiologically active or carcinogenic substances. By way of example, such products can include per- or polychlorinated and per- or polyfluorinated aliphatic or aromatic substances such as chlorophenols, dioxins and furans. In addition to their toxicity, these compounds often exhibit high chemical and thermal resistance.

Waste matter destruction is becoming a problem of great magnitude throughout the world. Two methods of removing contaminated material have become established, namely land fill and high temperature combustion techniques.

In the land fill technique, which generally only applies to solids, the toxic matter is not destroyed, but is simply stored in dumps. At best the dumps are designed to prevent contamination of ground water by waste matter deposited therein. This technique is not suited to some areas, for example, areas in which there is an ongoing danger of leakage, seepage or the like.

In the high temperature combustion technique, the generally attainable temperatures, for example up to 1500° C., are insufficient to destroy all the toxic substances. The most thermally stable harmful substances are thus delivered into the atmosphere. Further the combustion process can promote the formation of additional dioxins and furans which are then also delivered into the atmosphere.

Thus there are disadvantages associated with each of the techniques described above.

It is an object of the invention to provide an improved method and apparatus for material processing.

It is a further object of the invention in one form to provide a process for destroying toxic waste matter in an effective and convenient manner. It is still a further object of the invention in one form to provide suitable waste destruction apparatus. It is yet another object of the invention to provide a process for waste destruction, and apparatus for that purpose, which can be used at or close to the site at which waste products are generated.

A process for material processing according to the invention is characterised in that a body of material is introduced into a pyrolyser and is subjected to high temperature for a period of time sufficient to achieve substantially complete pyrolysis, after which the material leaves the pyrolyser and is then subjected to rapid quenching. In one form of the process, the quenched material is subjected to an environment in which residual toxic compounds are adsorbed on a solid carrier substance so as to be thereby capable of separation from the main body of the material.

It is preferred that the solid carrier substance referred to above is particulate carbon, and it is further preferred that the carbon is formed by the treatment of the waste material in the pyrolyser.

The material to be treated may be in the form of a liquid which is atomised on introduction to the pyrolyser. Alternatively, the material may be in a particulate solid form or in the form of a gas.

It is preferred that the pyrolyser includes a high energy electrothermal plasma into which the atomised material is injected so as to result in dissociation of the molecules of which the material is composed. The speed at which such dissociation occurs is governed, at least in part, by the temperature of the plasma. It is further preferred that the material emerges from the plasma arc as a stream which passes through a hot zone within which the temperature of the material is maintained at a sufficiently high level to encourage continuation of the pyrolysis which is commenced within the plasma. That may be achieved in a number of ways as hereinafter described. Residence time within the hot zone may be determined as appropriate to increase the probability that there is complete dissociation of all molecules within the material stream. The longer the time for which a particular material is subjected to heating, the greater the likelihood of decomposing compounds exhibiting high thermal resistance. Generally the higher the temperature, the greater will be the speed at which decomposition is accomplished.

The material stream is cooled by being subjected to rapid quenching in a cooling zone after leaving the hot zone, and the speed of quenching is preferably such as to prevent, or at least minimise, recombination of the dissociated ions.

Residual toxic compounds which are separated from the material stream by absorption on particulate carbon as previously described, may be destroyed by subjecting the particulate carbon to appropriate further treatment.

In a preferred form of the process, the aforementioned hot zone is defined by a tube (hereinafter called the flight tube) through which the material stream travels between the plasma arc and the cooling zone. The material stream preferably enters that tube immediately upon emerging from the plasma arc. The dimensions and construction of the flight tube can have an influence on the efficiency of the process as hereinafter discussed.

As described above, the pyrolysis of material such as waste material may result in production of carbon particles as soot or activated carbon, and those particles could influence downstream processing of the material. For example, the particles could block or partially block the flight tube. This will especially be the case where the material to be treated comprises mainly hydrocarbons. However where the material comprises mainly oxygen containing organic compounds, there may not be a problem with excessive carbon particles.

In one form of the process, oxygen is introduced into the plasma so as to react with carbon particles as may be formed, and thereby produce gaseous carbon compounds with the concomitant evolution of heat. Such addition of oxygen may therefore lower the level of solid carbon within the material stream so as to more easily facilitate downstream processing of that material for example, facilitate passage of the material stream through the flight tube. Furthermore, the liberated heat assists in maintaining the temperature of the material stream suitably high as it passes through the flight tube to resist recombination to form toxic compounds.

The need to convert solid carbon to gaseous carbon compounds by addition of oxygen to the process material may be eliminated, or at least reduced, by the dilution of the material to be processed in an inert carrier liquid which passes through the apparatus without affecting the reaction dynamics. The carrier liquid will have the effect of lowering the percentage by weight of carbon particles in the stream issuing from the plasma. Ideally the amount of inert carrier liquid added will be controlled to reduce the percentage by weight of carbon particles to a level that avoids blockages of equipment without the addition of any oxygen.

In some circumstances, the level of carbon particles in the material stream issuing from the flight tube may be such as to cause blocking or partially blocking at the cooling zone and/or at some other part of the apparatus following the cooling zone, and that may occur notwithstanding the introduction of oxygen into the plasma as described above. To overcome that problem, in one form of the process, further oxygen is added to the stream issuing from the flight tube so as to react with the carbon particles and lower the level of particles within the material stream. The reaction of the oxygen with the carbon is exothermic which assists in maintaining the temperature of the material stream suitably high until actual quenching of the stream takes place. The high temperatures tend to resist recombination of ions to form toxic compounds. It is preferred that a sharp temperature gradient be effectively provided at the cooling zone.

The cooled material may be exposed to an alkaline environment for encouraging the adsorption of any acidic residual toxic compounds on the carrier substance, for example carbon particles. Thus, toxic compounds which escape pyrolysis, or which are formed by recombination following pyrolysis, can be isolated on the carbon particles, and those particles may be separated from the remainder of the processed material by any suitable means. By way of example, that separation may be achieved through filtration.

The separated carbon particles, with toxic compounds adsorbed thereon, may be subjected to further treatment to decompose the toxic compounds. For example, the particles may be subjected to further treatment which leads to the toxic compounds being desorbed into a liquid which is then recirculated through the process.

Alternatively, the carbon particles may be disposed of by landfill. The procedure adopted in any circumstance will generally depend on the level of toxic compounds on the carbon particles.

In accordance with a further aspect of the invention there is provided material treatment apparatus including, a pyrolyser having means for generating a plasma arc and passage means for containing plasma beyond the region of said arc, material introducing means located at or adjacent the region of said arc and being operative to introduce material into said pyrolyser as a fine spray and/or as a gas, said pyrolyser being operative to maintain said introduced material at a high temperature so that substantially complete pyrolysis of said material is achieved and recombination of unwanted by-products is substantially prevented during movement of said material through said passage means to an exit end of said pyrolyser, and quenching means located at or adjcent said exit end and being operative to rapidly quench said material emerging from said exit end before the temperature of that emerging material falls to a level at which formation of said unwanted by-products will occur.

Embodiments of the invention are described in detail in the following passages of the specification which refer to the accompanying drawings. The drawings, however, are merely illustrative of how the invention might be put into effect, so that the specific form and arrangement of the various features as shown is not to be understood as limiting on the invention.

Figure 1:
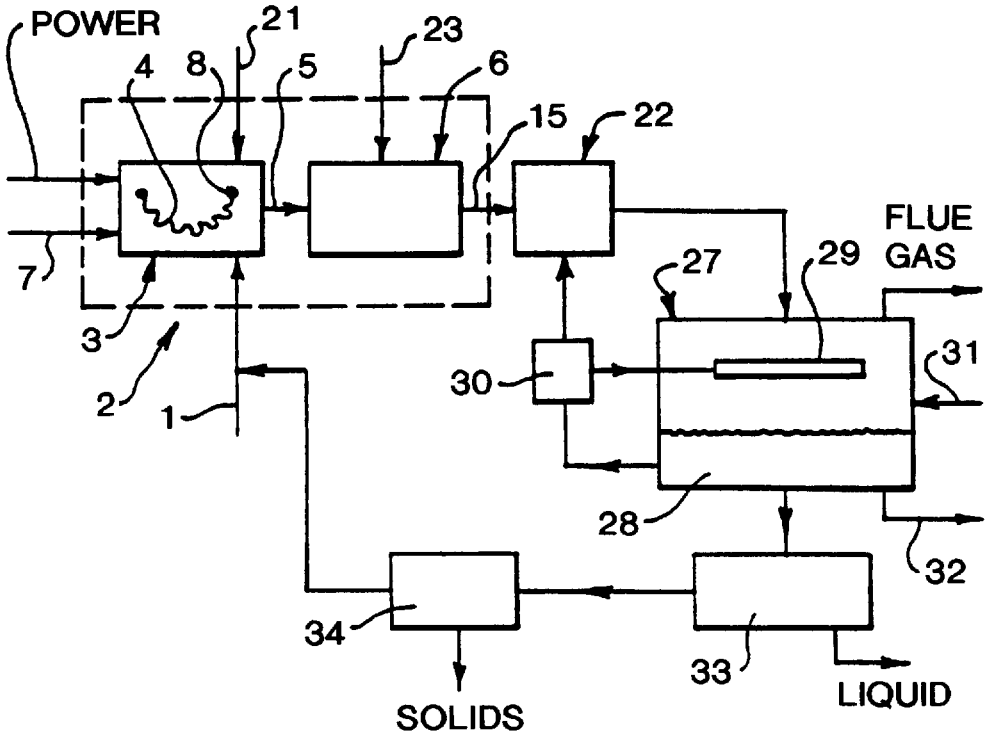
FIG. 1 is a flow diagram representing one form of the process according to the invention.

In FIG. 1 the line 1 represents the path of the material to be treated as it is introduced into the pyrolyser 2. The material may be introduced into the pyrolyser 2 in any suitable form, but it is preferred that it be in the form of a fine spray of liquid and/or solid particles, or a gas, or a combination of such a fine spray and a gas. It is further preferred that the material be injected into the pyrolyser 2 under pressure.

In the event that the material is moved along the path 1 as a stream of liquid, the stream of liquid may be atomised at or immediately preceding the point of injection into the pyrolyser 2, and any suitable nozzle or other means may be used for that purpose. Preferably, the liquid droplets resulting from the atomisation have a diameter of 100 microns or less. In particular, the liquid droplets need to be sufficiently small to enable complete pyrolysis. If they are too large, the surface of the droplets may merely char under the conditions existing within the pyrolyser 2.

If the material entering the pyrolyser 2 is in the form of or includes a spray of solid particles, each of those particles is preferably of a suitably small size for the reason given above. A particle size of 100 microns or less will generally be satisfactory.

The pyrolyser 2 includes means 3 for generating a plasma arc 4 so as to enable production of a high energy electrothermal plasma. The pyrolyser 2 also includes a hot zone 6 immediately following the arc generating means 3 and which receives the material stream 5 emerging from the arc generating means 3.

It is preferred that the plasma gas 7 is argon or an argon mixture as that produces an inert plasma atmosphere in which the pyrolysis takes place. The arc generating means 3 may, for example, be a plasma torch the same as or similar to that disclosed by PCT Patent Application AU89/00396. In that regard, the temperature within the plasma may typically be in the region 10,000° C. to 15,000° C. Alternatively, other types of plasma such as a steam plasma may also be used.

The direction in which the material to be treated is introduced into the plasma arc 4 may be selected according to preference or circumstances. By way of example, the direction may be generally parallel to the line of the arc 4, or generally transverse thereto, but the later is usually preferred.

It is preferred that the region of the pyrolyser 2 at which the material to be treated is introduced into the plasma, is maintained at a suitably high temperature, for example, a temperature of 1,000° C. or preferably higher. The material may be injected directly into the core of the plasma arc 4, or at least close to the downstream attachment 8 of the arc 4. If direct injection is not possible, the surfaces of the torch 3 in the region of material introduction may be heated to maintain a temperature of a suitably high level.

Figure 2:
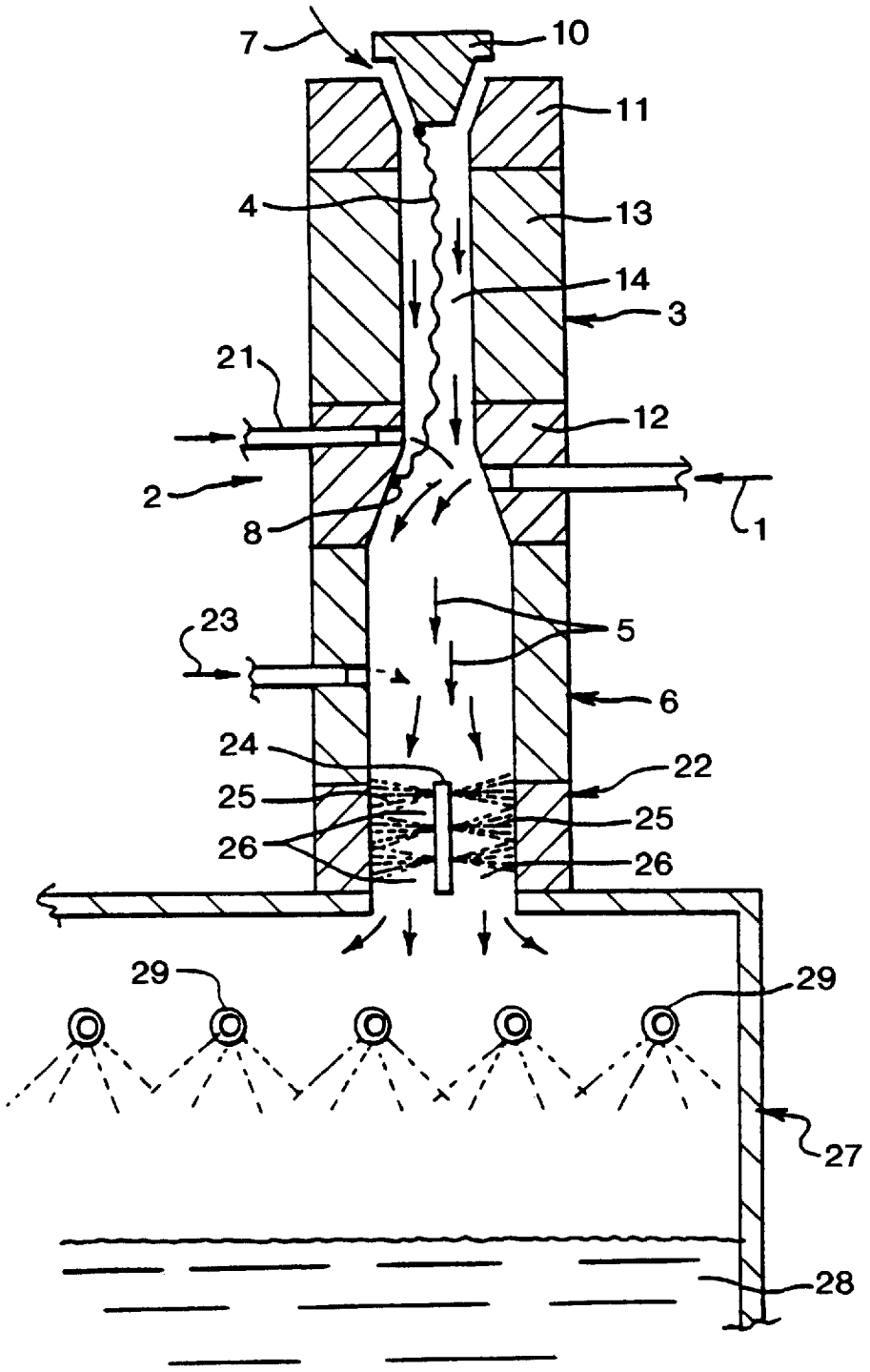
FIG. 2 is a diagrammatic sectional view through one form of pyrolyser for use in a process as represented by FIG. 1.

FIG. 2 provides a clearer indication of the preferred location of the point 9 at which material to be treated is introduced into the pyrolyser 2. The particular torch 3 which is shown in FIG. 2, and which forms part of the pyrolyser 2, includes a cathode 10 and two anodes 11 and 12 separated by a bank 13 of spacers. The anode 11 functions as a start-up anode for initiating the arc 4, and once generated the arc 4 is then extended so that its downstream attachment 8 is at the anode 12. Other forms of torches could be adopted.

In the particular arrangement shown in FIG. 2, material to be treated is injected into the torch passage 14 at or adjacent the location of the arc attachment 8. The direction of that injection is generally transverse to the longitudinal axis of the passage 14 as that facilitates injection into the core of the arc 4.

The molecules which make-up the injected material are caused to dissociate under the influence of the high temperatures prevailing within the plasma, and the material thereby undergoes pyrolysis, or at least substantial pyrolysis. The material emerges from the plasma arc 4 as a stream 5 which is directed into and through the hot zone 6. The stream of material 5 is primarily a gas having associated therewith particles of solid carbon in the form of soot.

In the particular arrangement shown, the hot zone 6 is formed by an elongate hollow tube which will be hereinafter referred to as the flight tube. The tube 6 in effect forms an extension or continuation of the torch passage 14, and the dimensions of the tube 6 will be selected to suit particular requirements and circumstances. It is a basic function of the tube 6 to provide containment of the material stream 5 in an environment which promotes continuation of the pyrolysis process. That is, it may happen that pyrolysis of the material is not completed within the torch 3, and the function of the tube 6 is to provide an extension of the environment within which pyrolysis takes place. In particular, the tube 6 extends the residence time of the material within an appropriate high temperature environment and thereby optimises the possibility that complete pyrolysis will be achieved.

In one arrangement which has operated satisfactorily, the flight tube is slender and has a diameter to length ratio of about 2 in 25. In any particular circumstances however, the length of the tube may be selected so as to achieve a suitable residence time of the processed material within the tube and any suitable diameter to length ratio may be adopted. The nature of the toxic compounds within the material to be treated will influence the determination of an appropriate residence time within the tube 6.

An important consideration in the design of the tube 6 is the need to maintain the processed material at as high a temperature as possible along the length of the tube, as that assists in preventing undesirable recombination reactions. In that regard, the temperature of the stream 5 entering the tube 6 may be above 3,500° C. and the temperature of the stream exiting the tube 6 may be 1,200° C., or thereabouts.

The fluid flow boundary layer of the material stream which contacts the surrounding surface of the tube 6 will tend to cool because of that contact. Accordingly the tube 6 may be designed in such a way as to enable control of the boundary layer so that it is kept as thin as possible. In particular, it is desirable that the temperature of the material stream is substantially consistent throughout that stream as it emerges from the exit end 15 of the pyrolyser 2.

Figure 3:
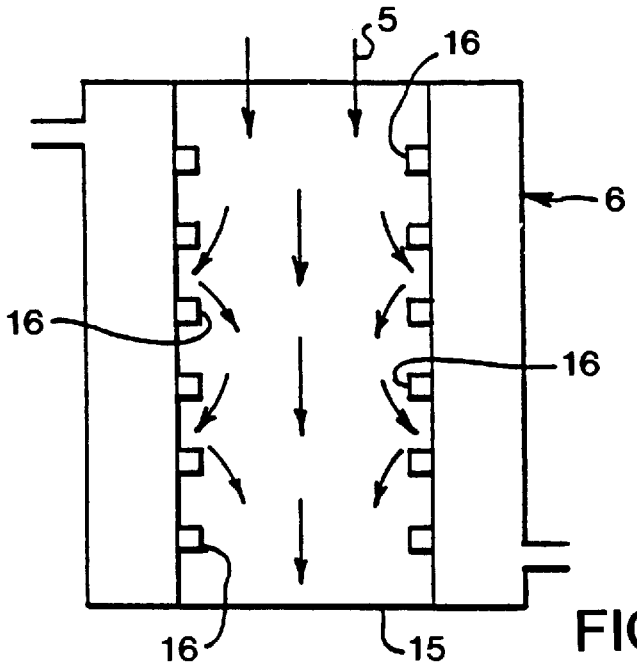
FIG. 3 is a semi-diagrammatic cross-sectional view of one form of flight tube suitable for use in the apparatus shown by FIG. 2.

One approach to the foregoing is shown diagrammatically in FIG. 3. The inner surface of the flight tube 6 shown in FIG. 3 is provided with a series of lips 16 which tend to deflect the boundary layer of the material stream 5 back towards the axial center of that stream. The resulting turbulence inhibits the formation of a distinct cool boundary layer, and there is continual mixing of the boundary layer with the inner relatively hot body of the material stream such that a substantially consistent temperature is maintained across the width of the stream.

Figure 4:
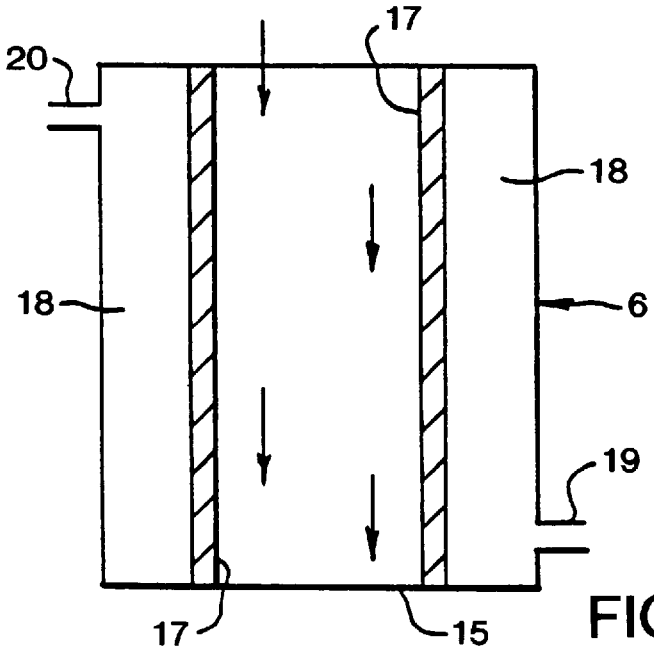
FIG. 4 is a semi-daigrammatic cross-sectional view of another form of flight tube suitable for use in the apparatus of FIG. 2.

FIG. 4 illustrates another approach in which the tube 6 has a lining 17 which is capable of withstanding high temperatures, and particularly temperatures above 1,000° C. By way of example, the lining 17 may be composed of a ceramic material. If desired, such an arrangement may be modified by introducing an external source of heat to the lining 17 at an appropriate location, such as adjacent to the exit end 15 of the pyrolyser 2. Also, the body 18 of the tube 6 which surrounds the lining 17 may be cooled by water (for example) entering at the inlet 19 and exiting at the outlet 20. Similar cooling may be desirable in other forms of the tube 6, including that shown in FIG. 3.

As previously mentioned, the material stream 5 issuing from the torch 3 will contain carbon particles. If the level of carbon particles is relatively high, there may be a danger of the carbon blocking the tube 6. In order to alleviate that problem, a stream of oxygen may be fed into the pyrolyser 2 for converting some of the carbon particles to gaseous carbon compounds. In the particular example shown in FIGS. 1 and 2, the oxygen is fed into the torch 3 at a location 21 adjacent the point 9 at which the material to be treated is introduced. Other arrangements are clearly possible.

The reaction of carbon and oxygen is exothermic and a considerable amount of heat is liberated. This heat assists in maintaining the temperature of the material stream at a suitably high level to encourage continuation of the pyrolysis and to resist recombination of dissociated ions and simple compounds to form undesirable compounds.

In one possible arrangement, the tube 6 may include a graphite lining. In such a case, it may be important to control the stream of oxygen entering at 21, so as to maintain an oxygen deficient atmosphere within the tube 6. By way of example, the ratio of oxygen to carbon may be maintained at 30% below stoichiometric levels. If such an atmosphere is not maintained some oxygen may react with the carbon of the tube lining, thereby eating away the lining.

An oxygen deficient atmosphere will also tend to reduce the combination of dissociated ions to form undesirable oxygen containing compounds.

The material stream 5 passing out of the exit end 15 of the pyrolyser 2 is subjected to quenching in a cooling zone 22. In the arrangement shown, the material is then, and/or subsequently, subjected to an environment as hereinafter described in which residual toxic organic compounds are adsorbed on a particulate carrier. By way of example, the carrier substance may be provided by the unreacted carbon particles remaining within the material stream 5.

The level of carbon particles in the material stream 5 passing out of the exit end 15 may, for example, be 1% by weight, or greater. Such a level of carbon may cause clogging or blocking of components of the processing apparatus which follow the pyrolyser 2. Consequently, in some circumstances it may be desirable to further reduce the carbon content by the introduction of a further stream 23 of oxygen to convert some of the remaining carbon particles to gaseous carbon products. Preferably, the carbon content of the material stream entering the cooling zone 22 is in the order of 0.5% by weight.

The introduction of the further oxygen stream 23 may have another effect. That is, the heat generated by the reaction of that oxygen with carbon may assist in maintaining the material stream 5 at a suitably high temperature right up until actual quenching takes place. In that regard, it is desirable that the temperature of the material stream 5 just prior to quenching be at least 1,500° C., and it is preferred that the temperature be in order of 1,800° C. to 2,000° C.

As mentioned above, the higher temperatures resist recombination of dissociated ions to form toxic compounds, for example dioxins. Generally, it is thought desirable to maintain the temperature in the material stream 5 up to the time of quenching, at a level which is sufficiently high to avoid the possibility of CO in the stream 5 reforming into $CO_2$.

As indicated above, the introduction of the further stream 23 of oxygen will not be necessary in all applications of the invention.

In the particular configuration shown the cooling zone 22 includes a bank of sprays 24 arranged to produce a cool barrier 25 through which the material stream 5 must pass. That is, the stream 5 is confined to a passage 26 which is completely filled at the location of the sprays 24 by the barrier 25. The arrangement is such that quenching of the material stream is complete, and that as a result there is a very sudden sharp drop in the temperature of the material. In the example shown, the passage 26 is formed as an extension of the passage through the tube 6.

The cooled material issuing from the cooling zone 22 may be passed into and through a scrubber 27 as shown. The pH of the scrubber 27 will generally be alkaline for removing acidic compounds from the material received. The carbon particles within that material may be dispersed within a body 28 of the alkaline scrubber liquor so that acidic organic compounds are encouraged to be adsorbed on the carbon particles. The optimum process parameters such as pH and temperature of the scrubber liquor which are required to achieve maximum toxic organic compound adsorption, may be determined by routine experimentation.

In one particular example the scrubber liquor is a sodium hydroxide solution, but other types of liquor may be used. Furthermore, in the configuration illustrated by FIG. 1, the same liquor may be used in the quench sprays 24 and the scrubber sprays 29. For that purpose, a pump 30 may operate to draw liquor from the liquor body 28 to feed the sprays 24 and 29. The line 31 in FIG. 1 represents the supply of liquor to the scrubber 27, and the line 32 represents the withdrawal of spent liquor from the scrubber 27.

The carbon particles may be separated from the scrubber liquor by means of a simple filtration process, which is indicated in FIG. 1 by the block 33. That filtration may be carried out on a continuous basis or on a batch basis.

The toxic organic compounds adsorbed on the carbon particles may be separated from the carbon particles by a desorption process which is represented by the block 34 in FIG. 1. That is, the adsorption process effected in the scrubber 27 is reversed. The compounds are typically desorbed in water which can be recycled through the process as part of the material input 1.

In the particular construction shown by FIG. 2 the scrubber 27 has a rectangular configuration and is substantially larger than the tube which forms the cooling zone 22. A plurality of scrubber sprays 29 are located in the operatively upper region of the scrubber 27 for directing scrubber liquor as a fine spray or mist. The direction of that spray or mist is preferably downwards.

Figure 5:
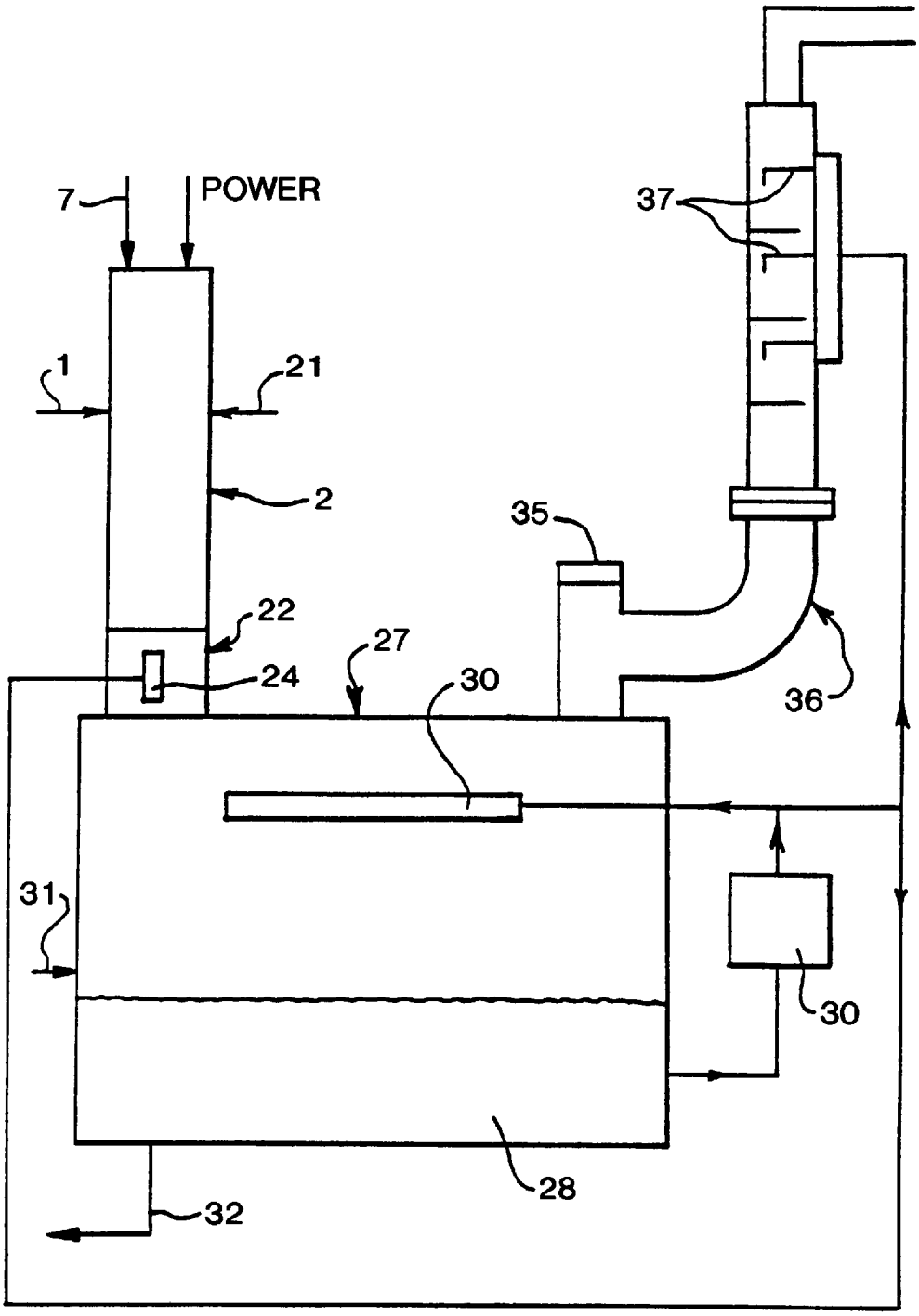
FIG. 5 is a diagrammatic view of apparatus in accordance with one embodiment of the invention.

The apparatus may include an explosion vent 35 as shown in FIG. 5, to vent the system in the event of the build-up of an explosive gaseous mixture. This is an important safety feature to reduce the danger of explosion. The explosion vent is of known form and construction. In the example shown, the vent 35 is located adjacent the scrubber 27.

The material which has remained in the gaseous form and which has not been scrubbed from the gas in the scrubber 27, may be passed to atmosphere by way of a stack 36 shown in FIG. 5. The stack 36 may, for example, include a number of stack sprays 37 which operate to remove any remaining traces of gaseous compounds having an affinity for an aqueous alkaline environment. In the particular arrangement shown, the stack sprays 37 are supplied with liquor by way of the pump 30.

The pyrolyser 2 specifically, and the entire apparatus more generally, forms a very compact unit which lends itself to on-site use. For example the apparatus can be integrated into an existing process so that there is no net production of toxic waste. This is a major advantage as the transportation of toxic substances is hazardous.

A unique characteristic of the process described is the deliberate retention of particulate carbon within the stream of material and the control of the process conditions such that the carbon particles act as a carrier substance for toxic organic compounds which have survived the pyrolysis phase of the process. That is, the organic compounds which survived the processing steps preceding the quenching process, are effectively captured by attachment or adsorption on the carbon particles. The surviving organic compounds are thereby captured in a manner which facilitates convenient disposal or alternatively subsequent processing as considered appropriate, depending on the level of toxic organic compounds. That is contrary to the accepted practice of inhibiting carbon formation in existing toxic compound destruction processes.

Analysis of material emerging from the scrubber has revealed that the level of destruction of toxic products in the process steps preceding the scrubber, is in the order of 99.9999%. Further treatment of the separated carbon particles enables the level of destruction to be increased beyond 99.9999%. A process according to the invention is useful for the effective destruction of a wide variety of toxic products, including chlorophenols and dioxins. The process is robust and safe.

Various alterations, modifications and/or additions may be introduced into the constructions and arrangements of parts previously described without departing from the spirit or ambit of the invention as defined by the appended claims.

We claim:

1. A material treatment process comprising the steps of forming a plasma within a pyrolyser wherein the temperature of the plasma is from 10,000° C. to 15,000° C., injecting material to be treated as a fine spray and/or as a gas into said plasma, moving said material as a stream through said pyrolyser in a direction towards an exit end of the pyrolyser, maintaining said material at a high temperature during said material stream movement so that substantially complete dissociation of said material is achieved and recombination of unwanted by-products is substantially prevented, moving said material stream through said exit end at a temperature above that at which said recombination will occur being a temperature of at least 1500° C., and subjecting said material stream to rapid quenching at or adjacent said exit end and before the temperature of said material stream falls to a level at which recombination to said unwanted by-products occurs.

2. A process according to claim 1, wherein the temperature of said material stream immediately prior to said quenching is such that CO in said material stream has not commenced to reform into $CO_2$.

3. A process according to claim 1, wherein said plasma is formed by use of a gas which is a noble gas.

4. A process according to claim 3, wherein said gas is argon or an argon mixture.

5. A process according to claim 1, wherein said plasma is generated by an electric arc created between two electrodes, and said material is injected into said plasma at a location adjacent the attachment of said arc to the electrode which forms the anode.

6. A process according to claim 1, wherein said plasma is generated by an electrical arc created between two electrodes, and said material is injected into the core of said arc.

7. A process according to claim 5 or 6, wherein said material is injected in a direction extending generally transverse to the direction in which said arc extends between said electrodes.

8. A process according to claim 1, wherein said material is injected into said pyrolyser in the form of atomized liquid.

9. A process according to claim 8, wherein the size of the liquid droplets forming said atomized liquid is 100 microns or less.

10. A process according to claim 1, wherein said material is injected into said pyrolyser in the form of solid particles.

11. A process according to claim 10, wherein the size of said particle is 100 microns or less.

12. A process according to claim 1, wherein oxygen is introduced into said pyrolyser at or adjacent the location of said material injection.

13. A process according to claim 1, wherein a partially oxidizing atmosphere exists within said pyrolyser.

14. A process according to claim 1, wherein said pyrolyser includes a plasma torch and a hot zone extending between said torch and the location at which said quenching takes place.

15. A process according to claim 14, wherein said hot zone is formed within a tube and a boundary layer of said material which contacts the surrounding surface of said tube is controlled so that the material within said material stream is at a substantially consistent temperature at the time it is subjected to said quenching.

16. A process according to claim 1, wherein said pyrolyser includes a tube through which said material passes towards said exit end, and a boundary layer of said material which contacts the surrounding surface of said tube is controlled so that the material within said material stream is at a substantially consistent temperature at the time it is subjected to said quenching.

17. A process according to claim 15 or 16, wherein said boundary layer is controlled by inducing turbulent flow in said boundary layer.

18. A process according to claim 15 or 16, wherein said boundary layer is controlled by deflecting it inwards towards the center of said material stream.

19. A process according to claim 15 or 16, wherein said boundary layer is controlled by maintaining a suitably high temperature in a wall of said tube which forms said surrounding surface.

20. A process according to claim 1, wherein said quenched material is subjected to an environment in which residual toxic compounds are absorbed on a solid carrier substance, and said substance is thereafter separated from said material.

21. A process according to claim 20, wherein said carrier substance is particulate carbon.

22. A process according to claim 21, wherein said carbon particles are formed by said pyrolysis.

23. A process according to claim 21 or 22, wherein said toxic compounds are desorbed from said carrier substance.

24. A material treatment process according to claim 1 wherein the temperature of the material just prior to quenching is at least 1800° C.

25. Material treatment apparatus comprising a pyrolyser having means for generating a plasma arc and passage means provided by a hollow tube for containing plasma beyond the region of said arc, material introducing means located at or adjacent the region of said arc and being operative to introduce material into said pyrolyser as a fine spray and/or as a gas, said pyrolyser being operative to maintain said introduced material at a high temperature so that substantially complete dissociation of said material is achieved and recombination of unwanted by-products is substantially prevented during movement of said material through said passage means to an exit end of said pyrolyser, wherein said passage means includes means providing for control of a boundary layer of said material for ensuring a substantially consistent temperature for the material across said passage means, and quenching means located at or adjacent said exit end and being operative to rapidly quench said material emerging from said exit end before the temperature of said emerging material falls to a level at which recombination to said unwanted by-products will occur.

26. Apparatus according to claim 25, wherein said generating means includes a plasma torch having a passage therethrough, and said material introducing means is arranged to introduce material into said passage in a direction which is substantially transverse to the longitudinal direction of said passage.

27. Apparatus according to claim 26, wherein said plasma containing means includes a tube which forms a continuation of said plasma torch passage.

28. Apparatus according to claim 25, wherein said generating means includes a cathode and an anode arranged in spaced relationship from said cathode, and said material introducing means is located at said anode.

29. Apparatus according to claim 25, wherein said quenching means is located at said exit end and is operable to produce a cool barrier through which material exiting said pyrolyser must pass.

* * * * *

UNITED STATES PATENT AND TRADEMARK OFFICE

CERTIFICATE OF CORRECTION

PATENT NO. : 5,866,753

DATED : February 2, 1999

INVENTOR(S) : Rowan Thomas Deam, et al.

It is certified that error appears in the above-identified patent and that said Letters Patent is hereby corrected as shown below:

On the title page: Item [73] Assignee: should read -- Commonwealth Scientific & Industrial Research Organisation, Campbell, Australia; and Siddons Ramset Limited, Croyden North, Australia--.

Signed and Sealed this

Fourteenth Day of September, 1999

*Attest:*

Q. TODD DICKINSON

*Attesting Officer*

*Acting Commissioner of Patents and Trademarks*